US008662869B2

(12) United States Patent
Suzuki et al.

(10) Patent No.: US 8,662,869 B2
(45) Date of Patent: Mar. 4, 2014

(54) MULTI-STAGE DRY PUMP

(75) Inventors: Toshio Suzuki, Chigasaki (JP); Tomonari Tanaka, Chigasaki (JP)

(73) Assignee: ULVAC, Inc., Chigasaki-Shi (JP)

( * ) Notice: Subject to any disclaimer, the term of this patent is extended or adjusted under 35 U.S.C. 154(b) by 964 days.

(21) Appl. No.: 12/742,654

(22) PCT Filed: Nov. 12, 2008

(86) PCT No.: PCT/JP2008/070562
§ 371 (c)(1),
(2), (4) Date: May 12, 2010

(87) PCT Pub. No.: WO2009/063890
PCT Pub. Date: May 22, 2009

(65) Prior Publication Data

US 2010/0266433 A1 Oct. 21, 2010

(30) Foreign Application Priority Data

Nov. 14, 2007 (JP) ..... P2007-296014

(51) Int. Cl.
*F01C 1/30* (2006.01)
*F03C 2/00* (2006.01)

(52) U.S. Cl.
USPC ..... 418/10; 418/9

(58) Field of Classification Search
USPC ..... 418/9–10
See application file for complete search history.

(56) References Cited

U.S. PATENT DOCUMENTS

| | | | | |
|---|---|---|---|---|
| 1,531,607 | A * | 3/1925 | Green | 418/9 |
| 4,828,467 | A * | 5/1989 | Brown | 418/201.1 |
| 5,356,275 | A * | 10/1994 | Brenner et al. | 418/9 |
| 5,779,453 | A | 7/1998 | Nagayama et al. | |
| 6,123,526 | A * | 9/2000 | Chen et al. | 418/9 |
| 6,699,023 | B2 * | 3/2004 | Naito et al. | 418/9 |
| 2003/0133817 | A1 | 7/2003 | Naito et al. | |
| 2005/0069440 | A1 | 3/2005 | Naito | |

FOREIGN PATENT DOCUMENTS

| | | |
|---|---|---|
| JP | 52-158908 | 12/1977 |
| JP | 56-167894 | 12/1981 |
| JP | 63-019090 | 2/1988 |
| JP | 09-032766 | 2/1997 |

(Continued)

OTHER PUBLICATIONS

Extended Search Report from EPO Application No. 08850687.8 dated Aug. 16, 2012.

(Continued)

*Primary Examiner* — Hoang Nguyen
(74) *Attorney, Agent, or Firm* — Grossman, Tucker, Perreault & Pfleger, PLLC

(57) ABSTRACT

A multi-stage dry pump includes: a plurality of pump chambers each including a cylinder and a rotor housed in the cylinder; a first rotor shaft that is a rotation shaft of the rotors; a fixed bearing that rotatably supports the first rotor shaft and restricts a movement thereof along an axis direction of the first rotor shaft; and a free bearing that rotatably supports the first rotor shaft and permits a movement thereof along the axis direction of the first rotor shaft; wherein: the plurality of pump chambers is disposed between the fixed bearing and the free bearing; and a first pump chamber of the plurality of pump chambers which has a lower pressure and on the aspiration side is placed in proximity to the fixed bearing.

3 Claims, 6 Drawing Sheets

(56) References Cited

FOREIGN PATENT DOCUMENTS

| | | |
|---|---|---|
| JP | 11-230060 | 8/1999 |
| JP | 2001-329985 | 11/2001 |
| JP | 2003-166483 | 6/2003 |
| JP | 2003-172282 | 6/2003 |
| JP | 2004-300964 | 10/2004 |
| JP | 2005-061421 | 3/2005 |
| JP | 2005-098210 | 4/2005 |
| JP | 2006-520873 | 9/2006 |
| KR | 10-0430126 | 9/2004 |
| KR | 10-2007-0023500 | 2/2007 |
| WO | 97/15759 | 5/1997 |
| WO | 2004/083643 | 9/2004 |

OTHER PUBLICATIONS

Office Action from corresponding Korean Application No. 10-2010-7010275 dated Jan. 17, 2012. English translation attached.

International Search Report from corresponding PCT Application No. PCT/JP2008/070562 dated Feb. 17, 2009.

* cited by examiner

MULTI-STAGE DRY PUMP

TECHNICAL FIELD

The present invention relates to a positive-displacement multi-stage dry pump.

Priority is claimed on Japanese Patent Application No. 2007-296014, filed Nov. 14, 2007, the content of which are incorporated herein by reference.

RELATED ART

A dry pump is used to discharge gases. The dry pump is provided with a pump chamber and a rotor is housed in a cylinder in the pump chamber. Discharge gases are compressed and displaced by rotating the rotor in the cylinder to discharge the gases to a low pressure. In particular, when discharging gases to $10^{-2}$-$10^{-1}$ Pa or to $10^{-4}$ Pa, a multi-stage dry pump is used to compress the discharge gases in a stepwise manner and discharge the gases. A multi-stage dry pump connects a plurality of pump-chamber stages in series from an aspiration port to an ejection port for discharge gases. In the multi-stage pump, discharge gases are sequentially compressed and the pressure increases from a low-pressure stage pump chamber in proximity to the aspiration port to a high-pressure stage pump chamber in proximity to the ejection port. Consequently, the volume of discharge gases can be decreased in sequence. The discharge gas volume in a pump chamber is proportional to the thickness of the rotor. Consequently, the thickness of the rotor gradually decreases from the low-pressure stage pump chamber to the high-pressure stage pump chamber (for example, refer to Patent Document 1).

When a dry pump is operated, the discharge gases are compressed in each pump chamber, generate heat and the temperature of the cylinder and the rotor increases. In this manner, there is the risk that the thermal expansion of the cylinder and the rotor will cause interference with each other. Thus Patent Document 2 proposes a technique of preventing interference of both components by regulating the linear expansion coefficient of both components with respect to the relationship between the temperature increase of the cylinder and the rotor.

Patent Document 1—Published Japanese Translation No. 2006-520873 of the PCT International Publication Patent Document 2—Japanese Unexamined Patent Application, First Publication No. 2003-166483

DISCLOSURE OF INVENTION

Problem to be Solved by the Invention

However, in a multi-stage dry pump, a plurality of pump-chamber stages is disposed along an axial direction of the rotor shaft. Consequently, the amount of thermal expansion of each pump chamber accumulates along the axial direction of the rotor shaft. Moreover since the thickness of the rotor in each pump chamber is different, the amount of thermal expansion is also different. The technique disclosed in Patent Document 2 has difficulty in preventing interference between the rotor and the cylinder in the plurality of pump chambers disposed along the axial direction of the rotor shaft even when interference of the rotor and the cylinder in a single pump chamber is prevented. As a result, it is necessary to design a large gap between the rotor and the cylinder in all pump chambers. In addition, the back-flow amount of discharge gases in that gap increases and the gas discharge capacity of the dry pump decreases.

Therefore the present invention has an object of providing a multi-stage dry pump enabling reduction of the gaps between the rotor and the cylinder.

Means for Solving the Problem (1) A multi-stage dry pump according to one aspect of the present invention adopts the following configuration: a multi-stage dry pump includes: a plurality of pump chambers each including a cylinder and a rotor housed in the cylinder; a first rotor shaft that is a rotation shaft of the rotors; a fixed bearing that rotatably supports the first rotor shaft and restricts a movement thereof along an axis direction of the first rotor shaft; and a free bearing that rotatably supports the first rotor shaft and permits a movement thereof along the axis direction of the first rotor shaft; wherein: the plurality of pump chambers is disposed between the fixed bearing and the free bearing; and a first pump chamber of the plurality of pump chambers which has a lower pressure and on the aspiration side is placed in proximity to the fixed bearing.

In low-pressure stage pump chambers which are provided on the aspiration side and have lower pressure, since the amount of temperature increase of the rotor and the cylinder due to the compression heat of the discharge gases is small, the difference in the amount of thermal expansion between both components is small. Consequently, it is possible to design extremely gap in the axial direction between the rotor and the cylinder in the low-pressure stage pump chambers. As the amount of thermal expansion of the plurality of stages of pump chambers builds up from the fixed bearing to the free bearing, since the low-pressure stage pump chamber which has a small amount of thermal expansion is disposed near to the fixed bearing, the integral amount of thermal expansion at the position of the low-pressure stage pump chambers can be maintained low. In this manner, it is possible to decrease the gaps in each pump chamber.

(2) The multi-stage dry pump above may be configured as follows: the multi-stage dry pump above may further include: an electrical motor that is disposed on an opposite side of the fixed bearing with respect to the free bearing and that applies a rotational drive force to the first rotor shaft; a second rotor shaft that is a rotation shaft for another plurality of the rotors; and a timing gear that is disposed between the fixed bearing and the electrical motor, and that transmits a rotation drive force from the first rotor shaft to the second rotor shaft.

In this case, (A) the electrical motor and the timing gear and fixed bearing, and (B) the high-pressure stage pump chamber and the bearing, which are the heat generation sources, are provided on opposite sides of (C) the low-pressure stage pump chamber and are disposed and distributed on both sides. In this manner, it is possible to cause the temperature distribution in the multi-stage dry pump uniform, and it is possible to suppress a maximum temperature in the multi-stage dry pump to a low value. Thus it is possible to decrease the aforementioned gaps in each pump chamber.

(3) The multi-stage dry pump above may be configured as follows: a heat transmission member having a higher heat transmission capacity than the first rotor shaft is disposed in an inner section of the first rotor shaft, and the end of the heat transmission member is exposed to the end of the first rotor shaft on the free bearing side.

In this case, the heat of the rotor is transmitted to the end of the rotor shaft through the heat transmission member and radiated from the end of the rotor shaft. Consequently, it is possible to efficiently remove heat from the rotor.

Furthermore, the high-pressure stage pump which has a large amount of heat generation is disposed on the free bearing side which does not have a timing gear or an electrical motor which are heat generation sources. Then, the heat of the high-pressure stage pump is radiated to the free bearing side. Consequently, it is possible to efficiently remove heat from the rotor.

(4) The multi-stage dry pump above may be configured as follows: a gap in the axis direction between the rotor and the cylinder in a pump chamber which has the maximum compression work amount among the plurality of pump chambers is larger than a gap in the axis direction of the rotor and the cylinder in the other pump chambers of the plurality of pump chambers.

In this case, since the gap in a low-pressure stage pump chamber which has a small compression work amount is designed to be smaller, even when the gap in a high-pressure stage pump chamber which has a large compression work amount is designed to be larger, it is still possible to maintain a gas discharge capacity for the overall multi-stage dry pump. Therefore, heat generation is suppressed and the compression ratio in the pump chamber which has a maximum compression work amount is decreased by increasing the gap in the pump chamber which has a maximum compression work amount and therefore it is possible to maintain the overall multi-stage pump not exceeding a safely and continuously operable temperature.

EFFECT OF THE INVENTION

According to the present invention, since the lower pressure pump chambers having smaller amount of thermal expansion are disposed closer to the fixed bearing, it is possible to decrease the accumulation amount of the amount of thermal expansion from the fixed bearing to the free bearing. Thus, it is possible to decrease the gap in an axial direction between the rotor and the cylinder in each pump chamber.

DESCRIPTION OF THE REFERENCE NUMERALS

Figure 1:
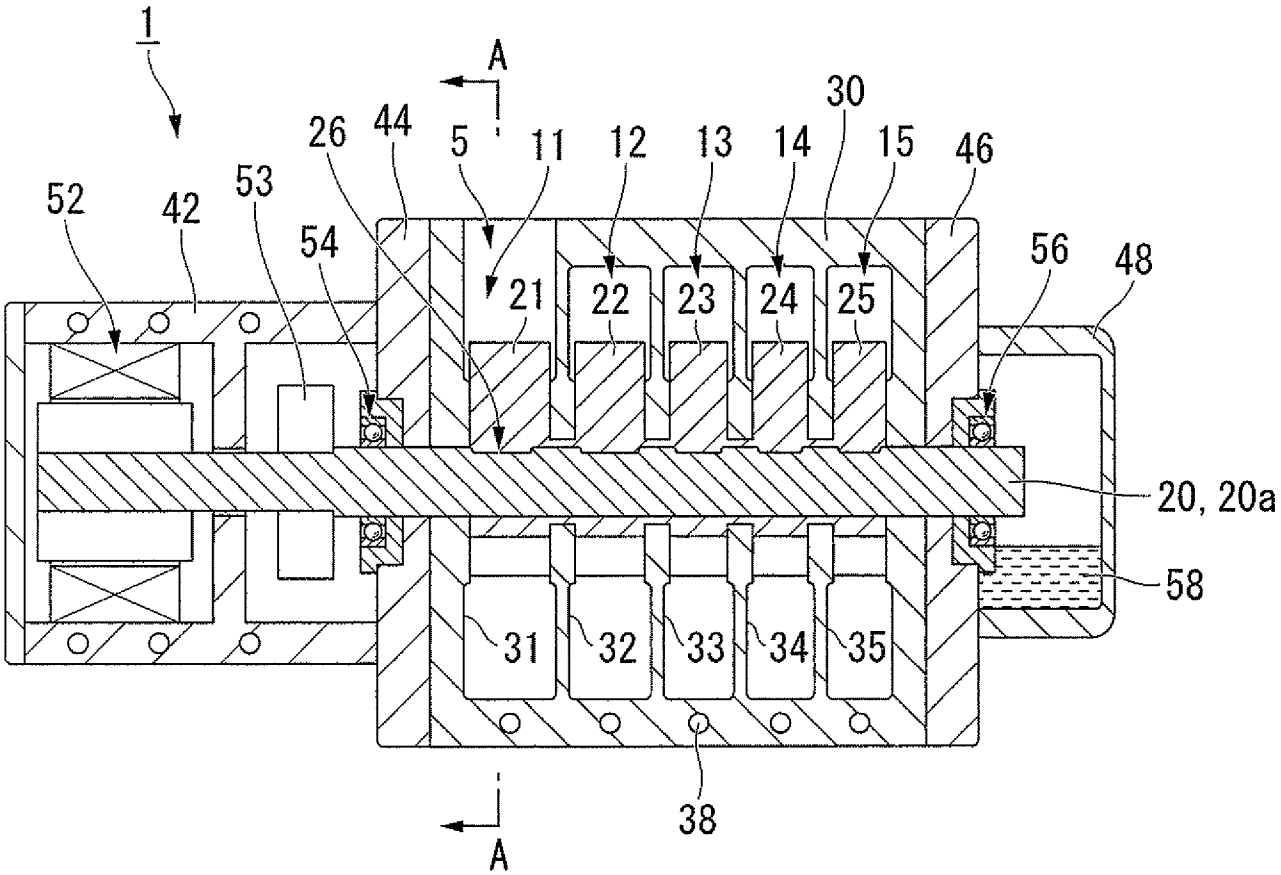
FIG. 1 is a lateral sectional view of a multi-stage dry pump according to a first embodiment of the present invention.

1 . . . multi-stage dry pump 11, 12, 13, 14, 15 . . . pump chamber 20 . . . rotor shaft 21, 22, 23, 24, 25 . . . rotor 31, 32, 33, 34, 35 . . . cylinder 52 . . . motor (electrical motor) 53 . . . timing gear 54 . . . fixed bearing 56 . . . free bearing

BEST MODE FOR CARRYING OUT THE INVENTION

The multi-stage dry pump according to an embodiment of the present invention will be described hereafter using the figures.

(Multi-Stage Dry Pump)

Figure 2:
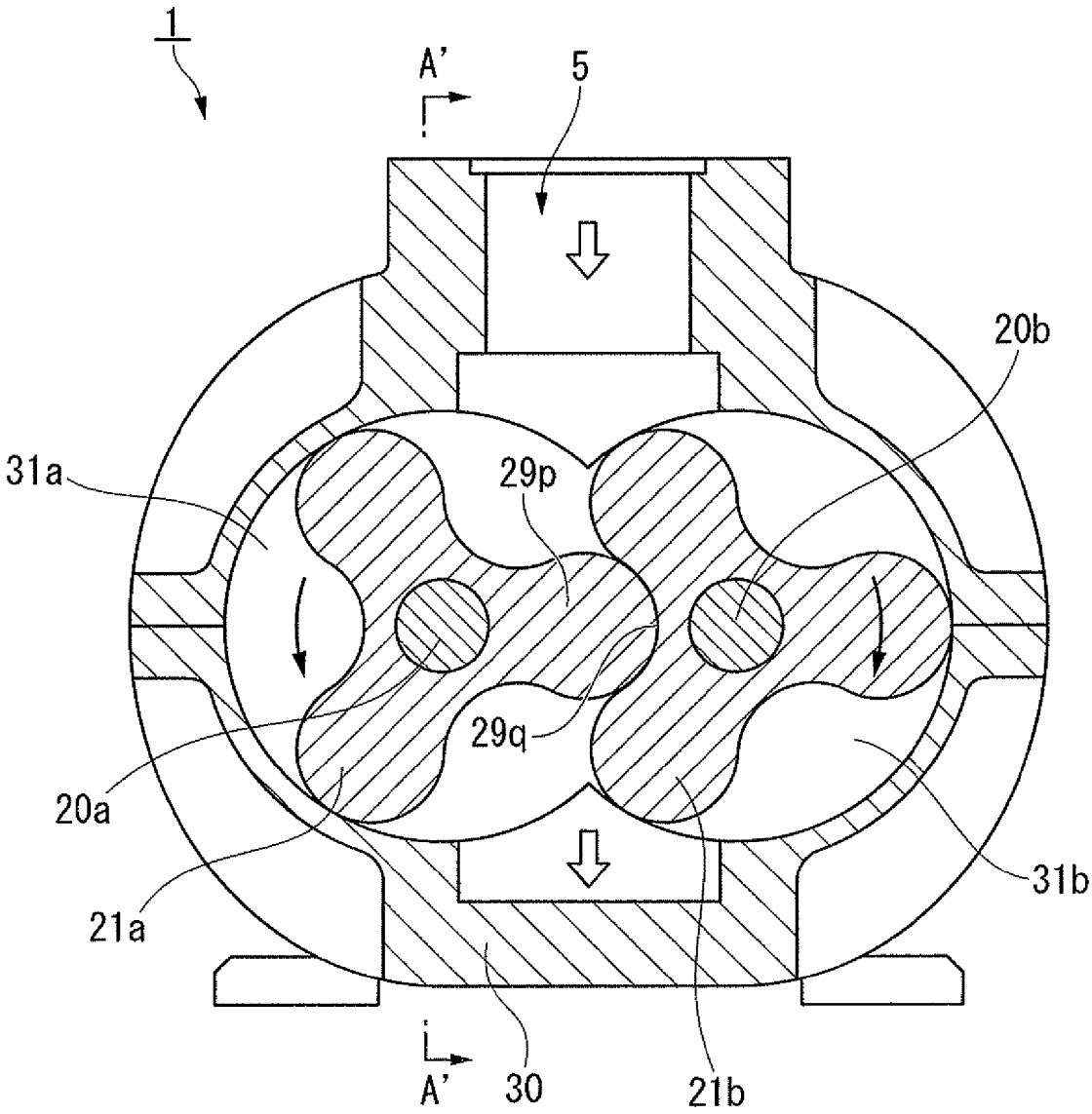
FIG. 2 is a front sectional view of the multi-stage dry pump.

FIG. 1 and FIG. 2 are explanatory view of a multi-stage dry pump according to a first embodiment. FIG. 1 is a lateral sectional view along the line A'-A' in FIG. 2. FIG. 2 is a front sectional view along the line A-A in FIG. 1. As shown in FIG. 1, in a multi-stage dry pump (hereafter, may be simply referred to as "multi-stage pump") 1, a plurality of rotors 21, 22, 23, 24, 25 having different thicknesses is respectively housed in cylinders 31, 32, 33, 34, 35. A plurality of pump chambers 11, 12, 13, 14, 15 is formed along the axial direction of the rotor shaft 20.

As shown in FIG. 2, the multi-stage pump 1 is provided with a pair of rotors 21*a*, 21*b* and a pair of rotor shafts 20*a*, 20*b*. The pair of rotors 21*a*, 21*b* is disposed so that a projecting section 29*p* of one rotor 21*a* meshes with an indented section 29*q* of the other rotor 21*b*. The rotors 21*a*, 21*b* rotate in an inner section of the cylinder 31*a*, 31*b* together with the rotation of the rotor shaft 20*a*, 20*b*. When the pair of rotor shafts 20*a*, 20*b* is rotated in mutually opposite directions, gas disposed between the projecting section 29*p* of the rotor 21*a* and 21*b* displaces and is compressed along the inner face of the cylinders 31*a*, 31*b*.

As shown in FIG. 1, a plurality of rotors 21-25 is disposed along the axial direction of the rotor shaft 20. Each rotor 21-25 is engaged in a groove section 26 formed on an outer peripheral face of the rotor shaft 20 to thereby restrict movement in a peripheral direction and axial direction. Each rotor 21-25 is housed respectively in the cylinders 31-35 and configures the plurality of pump chambers 11-15. Each pump chamber 11-15 is connected in series from an aspiration port 5 for the discharge gas to an ejection port (not shown) and configures the multi-stage dry pump 1.

Since the discharge gas is compressed and the pressure increases from a first stage pump chamber 11 on the aspiration port side (vacuum side, low-pressure stage) to a fifth pump chamber 15 on the ejection port side (atmosphere side, high-pressure stage), it is possible for the volume of discharge gas to be decreased in sequence. The discharge gas volume of the pump chamber is proportional to the rotation number and the ejection volume of the rotor. The ejection volume of the rotor is proportional to the number of blades (number of projecting sections) and thickness of the rotor. Consequently, the thickness of the rotor is decreased from the low-pressure stage pump chamber 11 to the high-pressure stage pump chamber 15. In the present embodiment, the first stage pump chamber 11 through the fifth stage pump chamber 15 are disposed from the fixed bearing 54 to the free bearing 56 described hereafter.

Each cylinder 31-35 is formed in an inner section of the center cylinder 30. Side cylinders 44, 46 are fixed to both axial ends of the center cylinder 30. The respective bearings 54, 56 are fixed to the pair of side cylinders 44, 46. The first bearing 54 fixed to one side cylinder 44 is a bearing having low axial play such as an angular shaft bearing or the like, and functions as a fixed bearing 54 for restricting axial movement of the rotor shaft. A second bearing 56 fixed to the other side cylinder 46 is a bearing having high axial play such as a ball bearing or the like and functions as a free bearing 56 for allowing axial movement of the rotor shaft. The fixed bearing 54 rotatably supports a proximate longitudinal central section of the rotor shaft 20 and the free bearing 56 rotatably supports a proximate longitudinal end section of the rotor shaft 20.

A cap 48 is attached to the side cylinder 46 to cover the free bearing 56. Lubrication oil 58 for the free bearing 56 is enclosed on an inner side of the cap 48.

On the other hand, a motor housing 42 is attached to the side cylinder 44. A motor 52 such as a DC brushless motor or the like is disposed on an inner side of the motor housing. The motor 52 applies a rotational drive force only to one rotor shaft 20*a* shown in FIG. 1 of the pair of rotor shafts 20*a*, 20*b*. The other rotor shaft transmits a rotational drive force through a timing gear 53 disposed between the motor 52 and the fixed bearing 54.

(Required Performance for Multi-Stage Dry Pump)

Next the performance required for a multi-stage pump will be described.

The basic performance required for a multi-stage pump requires a low ultimate pressure. An ultimate pressure is the minimum pressure at which a multi-stage pump can discharge gas as a sole unit. To decrease the ultimate pressure, the pressure difference of the aspiration side and the discharge side of the multi-stage pump may be increased. To increase the pressure difference, methods include (1) increasing the number of stages in the multi-stage pump, (2) decreasing the gap between the rotor and the cylinder, and (3) increasing the rotation number of the rotor.

One basic characteristics required during operations in medium to high pressure of the multi-stage pump is a high gas pumping speed. A gas pumping speed is the volume of discharge gases transported by the multi-stage pump per unit time. To maintain a high gas pumping speed in a wide pressure range, methods include (1) increasing the ejection volume of the pump chamber in the minimum pressure stage, (2) increasing the ejection volume ratio of the high-pressure stage pump chamber/low-pressure stage pump chamber, (3) decreasing the gap between the rotor and the cylinder, and (4) increasing the rotation number of the rotor.

It is effective to decrease the gap between the rotor and the cylinder (hereafter, may simply be referred to as "gap") in order to improve any of the basic characteristics above. The discharge gases flow from the aspiration port to the discharge port due to the rotation of the rotor and on the other hand, discharge gases back-flows through the gap between the rotor and the cylinder. Consequently, it is possible to decrease the amount of back-flow of discharge gases by decreasing the gap. The discharge efficiency (capacity) of the pump chamber is calculated by deducting the discharge gas flow amount flowing back in the gap from the discharge volume per unit time. The discharge volume per unit time of the pump chamber is expressed by product of the ejection volume based on the dimensions of the rotor and the rotor rotation number.

The gap between the rotor and the cylinder is designed taking into account (1) the difference in the amount of thermal expansion of the rotor and the cylinder and (2) the play of the mechanism section (for example, a bearing) and the mechanical processing accuracy. The thermal expansion amount of the rotor and the cylinder depends on the shape and temperature distribution and material of both components. In particular, when the rotor includes an aluminum alloy or uses a combination of an aluminum alloy and an iron alloy, the difference in the thermal expansion amount may increase. Consequently, it is sometimes the case that the gap between the rotor and the cylinder is designed larger.

However, the discharge gases are compressed in each pump chamber 11-15 and generate heat. The generated heat amount depends on the compression work amount of each pump chamber. The compression work chamber is expressed as the product of the ejection volume of the rotor and the pressure on the aspiration side of each pump chamber. Consequently, the heat generation amount of each pump chamber is proportional to the pressure on the aspiration side of each pump chamber. Furthermore the heat transmission amount from the discharged gas to the rotor and the cylinder is determined by the temperature of the discharged gas and the molecular density (that is to say, the absolute pressure). Consequently, the temperature of the rotor and the cylinder become higher in high-pressure stage pump chambers with a higher molecular density and a higher aspiration-side pressure. Thus, with respect to pump chambers in higher pressure stages, there is a tendency for the difference in the thermal expansion amount of the rotor and the cylinder to increase and for the gap to increase.

On the other hand, the back-flow amount of the discharge gases in the gap between the rotor and the cylinder is proportional to the average pressure on the aspiration side and discharge side of the pump chamber. Consequently, the back-flow amount of discharge gases in the gap increases in high-pressure stage pump chambers in which the average pressure is close to atmospheric pressure. Thus there is a need to design smaller gaps for pump chambers in higher pressure stages.

Figure 6:
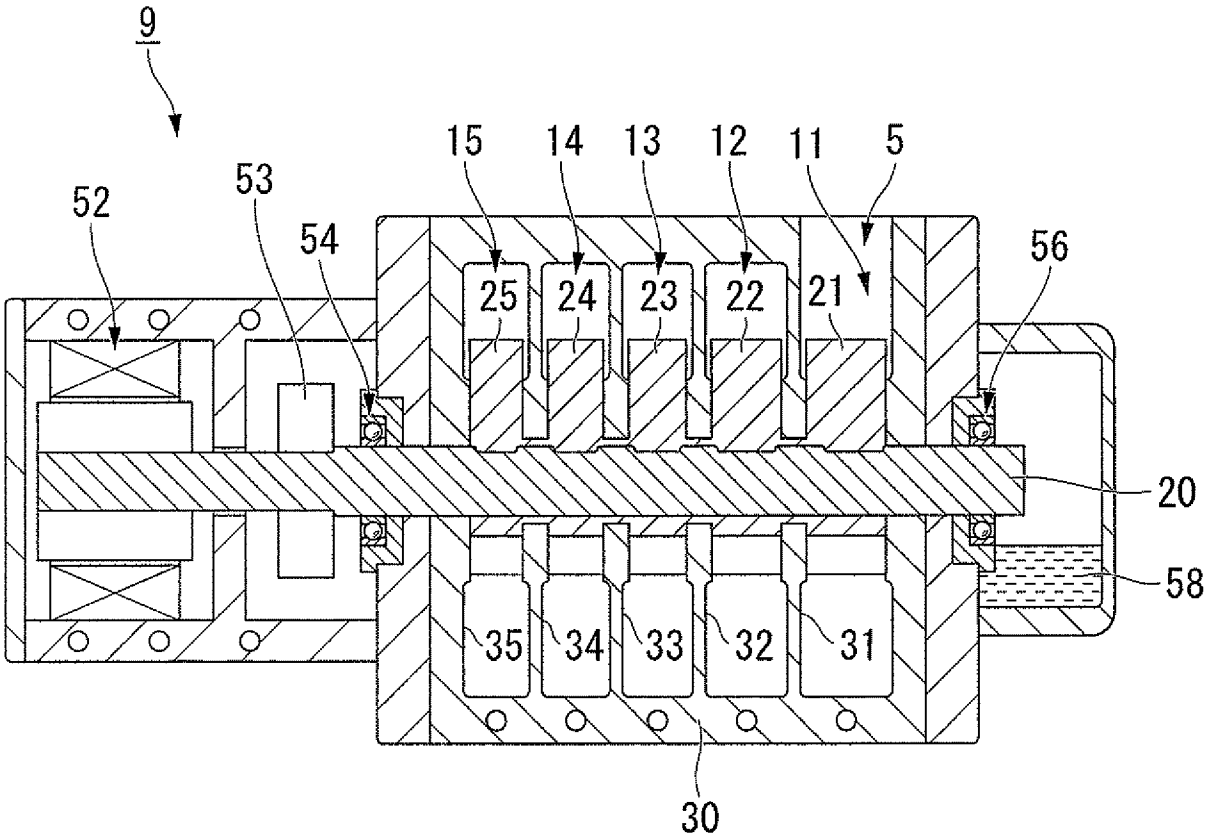
FIG. 6 is a lateral sectional view of a multi-stage dry pump according to a conventional technique.

FIG. 6 is a lateral sectional view of a multi-stage dry pump according to a conventional technique. The proximate central section of the rotor shaft 20 is supported by the fixed bearing 54 and the proximate end section is supported by the free bearing 56. A plurality of pump chambers 11, 12, 13, 14, 15 is disposed between the fixed bearings 54 and free bearings 56. As described above, although there is a tendency for the gap to increase in pump chambers of high-pressure stages, there is a need for small gaps to be designed. In a multi-stage pump 9 according to a conventional technique, components are disposed near to the fixed bearing 54 in pump chambers of high-pressure stages. In other words, each pump chamber 11-15 is disposed so that the pressure on the aspiration side of each pump chamber sequentially decreases in sequence from the fixed bearing 54 to the free bearing 56. The fixed bearing 54 restricts axial displacement of the rotor shaft 20. Consequently, the accumulation of the thermal expansion amount decreases in proximity to the fixed bearing 54. The gaps in high-pressure stage pump chambers which tend to increase are designed as small as possible by disposing components in proximity to the fixed bearing 54 in pump chambers in higher pressure stages.

However the thermal expansion amount of the plurality of stages of the pump chambers 11-15 accumulates from the fixed bearing 54 to the free bearing 56 which allows axial displacement of the rotor shaft 20. Consequently, the thermal expansion amount of high-pressure stage pump chambers accumulates in low-pressure stage pump chambers.

Figure 3A:
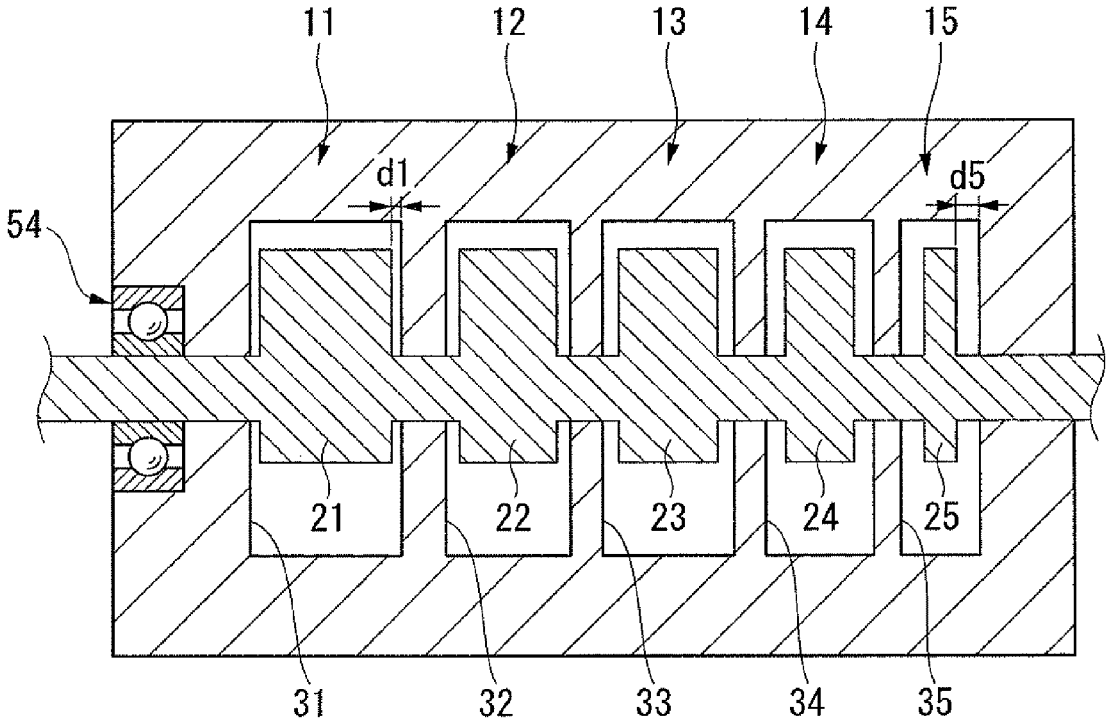
FIG. 3A is an explanatory view of the gap of each pump chamber according to the first embodiment of the present invention.
Figure 3B:
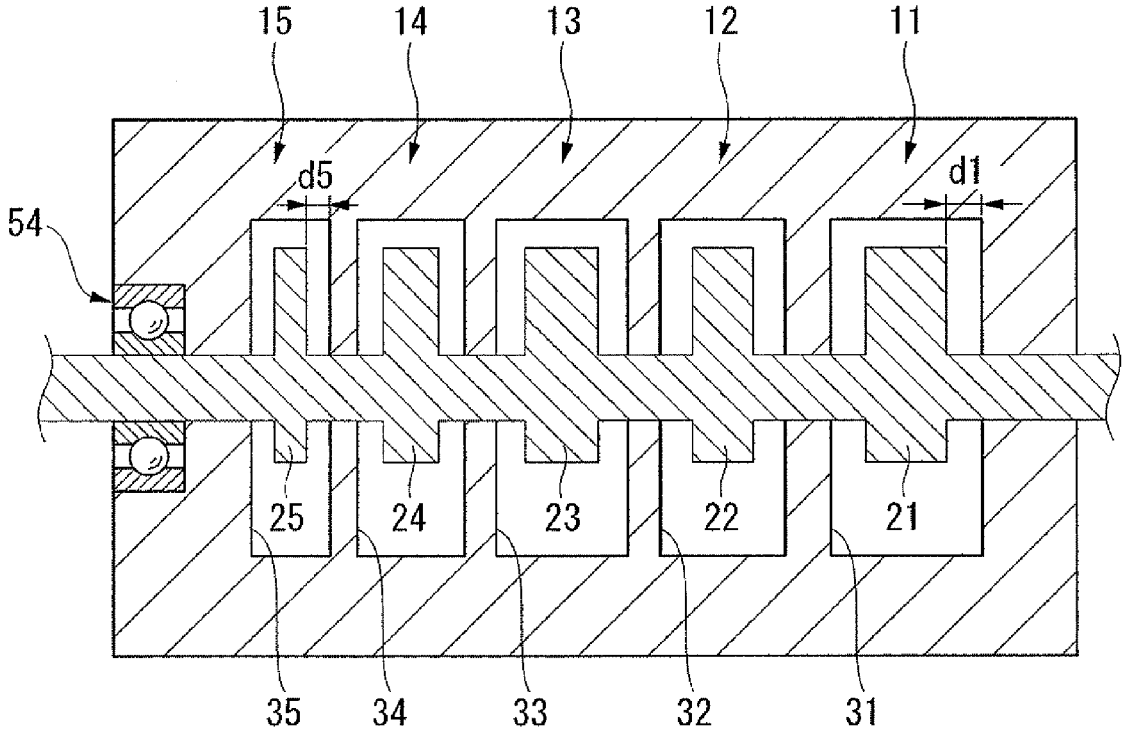
FIG. 3B is an explanatory view of the gap of each pump chamber according to a conventional technique.

FIG. 3B is an explanatory view of the gap of each pump chamber according to the first embodiment of the present invention. Since the thermal expansion amount of high-pressure stage pump chambers accumulates in low-pressure stage pump chambers, a gap d1 of the minimum-pressure stage pump chamber 11 is larger than a large gap d5 for the maximum-pressure stage pump chamber 15. Consequently, there is the problem that the discharge capacity of the overall multi-stage pump is decreased. Furthermore since the gap d1 of the minimum-pressure stage pump chamber 11 is enlarged, there is the problem that the ultimate pressure of the multi-stage pump cannot be decreased.

FIG. 3A is an explanatory view of the gap of each pump chamber according to the first embodiment. In contrast to the conventional technique, in the present embodiment, a plurality of pump chambers 11-15 is disposed from the fixed bearing 54 to the free bearing so that the aspiration-side pressure increases in sequence. In other words, components are disposed in proximity to the fixed bearing 54 in the pump chambers of low-pressure stages. Since the temperature increase amount of the rotor and the cylinder is small in the pump chambers of low-pressure stages in which the pressure on the aspiration side is low and the molecular density is low, the difference in the thermal expansion amount is decreased. Consequently, it is possible to design an extremely small gap d1 for the minimum-pressure stage pump chamber 11. Although the thermal expansion amount of the plurality of stages of the pump chambers 11-15 accumulates from the fixed bearing 54 to the free bearing, the accumulation amount of the thermal expansion amount can be decreased by performing disposing components in proximity to the fixed bearing 54 in the pump chambers of low-pressure stages which have a small thermal expansion amount. Consequently, the gap d5 for the maximum-pressure stage pump chamber 15 can be designed to be relatively small. In this manner, the gap of each pump chamber 11-15 can be decreased overall and it is possible to improve the discharge capacity of the overall multi-stage pump. Furthermore since the gap d1 of the minimum-pressure stage pump chamber 11 is decreased, it is possible to decrease the ultimate pressure of the multi-stage pump.

Figure 4:
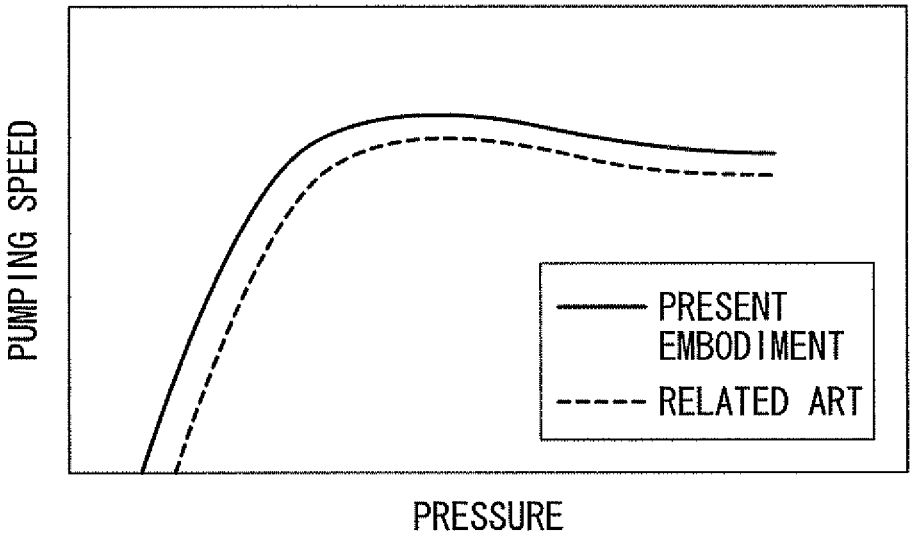
FIG. 4 is a graph showing the relationship between a pumping speed and a pressure on the aspiration side of a multi-stage pump.

FIG. 4 is a graph showing the relationship between pumping speed and pressure on the aspiration side of a multi-stage pump. In a multi-stage pump according to the present embodiment as configured above, the pumping speed at each pressure is increased and the ultimate pressure is decreased in comparison to a multi-stage pump according to a conventional technique.

However as described above, the discharge gas is compressed in each pump chamber 11-15 and generates heat. The generated heat is transmitted to the rotors 21-25 and the cylinders 31-35 as shown in FIG. 1 in addition to being discharged together with the discharged gases. The heat transmitted to the cylinders 31-35 is discharged through a cooling medium passage 38 disposed on the periphery of the cylinder. In contrast, the heat transmitted to the rotors 21-25 is transmitted to the cylinders 31-35 through the rotor shaft 20 and the bearings 54, 56 and is discharged through the cooling medium passage 38 of the cylinder.

When the rotation number of the rotor 21-25 is increased to improve the discharge capacity of the multi-step pump 1, the heat generation amount of discharge gas is increased due to the increase in the compression work amount. However since the cooling capacity of the cooling medium passage 38 disposed in the periphery of the cylinders 31-35 remains fixed, the heat generation amount exceeds the cooling capacity. When the heat generation amount exceeds the cooling capacity, there is the risk that the temperature of the multi-step pump will exceed the continuous use temperature for safe operation. The continuous use temperature for safe operation is the temperature at which the constitutive material of the multi-stage pump can be used as mechanism components (the temperature at which the material composition displays reversibility and at which strength is not adversely affected) and is determined depending on the application or the operation conditions of the multi-stage pump.

Thus to suppress the heat generation amount of discharge gases, an arrangement is necessary which decreases the compression work amount of the pump chambers. A means of decreasing the compression work amount of the pump chamber includes (1) decreasing the ejection volume of the rotor, or (2) enlarging the gap between the rotor and the cylinder. When the ejection volume is decreased, the discharge capacity of the multi-stage pump is decreased and specifications cannot be satisfied. Therefore a means of enlarging the gap between the rotor and the cylinder is adopted. In particular, it is desirable that the gap in the maximum-pressure stage pump chamber 15 in which the heat generation amount is a maximum is enlarged.

The gap required to realize the suppression of the heat generation amount is considerably larger than a gap set as described above taking into consideration (1) the thermal expansion difference of the rotor and the cylinder and (2) the play of the mechanism section and the mechanism processing accuracy. In the conventional technique shown in FIG. 3B, since the gaps in all the plurality of stages of pump chambers 11-15 are larger, when the gap for the maximum-pressure stage pump chamber 15 is further enlarged, it is difficult to ensure the discharge capacity of the overall multi-stage pump. In contrast, in the present embodiment as shown in FIG. 3A, since the gap for the low-pressure stage pump chamber having a small compression work amount is small, even when the gap for the maximum-pressure stage pump chamber 15 having a large compression work amount is enlarged, the discharge capacity of the overall multi-stage pump can be maintained. Thus, the heat generation amount in the maximum-pressure stage pump chamber 15 is suppressed and it is possible to maintain the overall multi-stage pump to a continuous use temperature for safe operation by enlarging the gap for the maximum-pressure stage pump chamber 15 which has a maximum compression work amount to be larger than the low-pressure stage compression chambers 11-14. Furthermore the compression work amount of the maximum-pressure stage pump chamber 15 is decreased and can be apportioned to the low-pressure stage pump chambers 11-14 to thereby enable uniformity of the temperature distribution of the multi-stage pump. Furthermore, it is possible to decrease the risk of contact between the rotor and the cylinder by enlarging the gap in the maximum-pressure stage pump chamber 15 which has the maximum heat expansion amount.

However the reason for heat generation in the multi-stage pump 9 shown in FIG. 6 is due to sliding friction of mechanism sections (timing gear 53 or bearings 54, 56 or the like) and due to operation of the motor 52 in addition to the compression and transportation of discharge gases as described above. It is desirable that a heat generation source is distributed and not concentrated in order to enable uniformity of the temperature distribution of the overall multi-stage pump. With respect to this point, the conventional technique shown in FIG. 6 disposes the motor 52, the timing gear 53, the fixed bearing 54, the maximum-pressure stage pump chamber 15, the pump chambers 14, 13, 12, the minimum-pressure stage pump chamber 11 and the free bearing 56 in sequence from the left side of the page. In this case, since components are concentrated from the motor 52 which is the heat generation source to the maximum-pressure stage pump chamber 15, it is difficult to make the temperature distribution of the multi-stage pump 9 uniform, and the maximum temperature in the multi-stage pump 9 increases.

In contrast, in the present embodiment as shown in FIG. 1, the motor 52 which applies a rotational drive force to the rotor shaft 20*a* is disposed on the opposite side of the free bearing 56 and sandwiches the fixed bearing 54. Furthermore the timing gear 53 which transmits the rotational drive force to the rotor shaft 20*b* (refer to FIG. 2) and forms a pair with the rotor shaft 20*a* is disposed between the fixed bearing 54 and the motor 52. In other words, from the left side of the page in FIG. 1, the motor 52, the timing gear 53, the fixed bearing 54, the minimum-temperature stage pump chamber 11, the pump chambers 12, 13, 14, the maximum-pressure stage pump chamber 15 and the free bearing 56 are disposed in sequence. In this case, (A) the motor 52, the timing gear 53 and the fixed bearing 54 which are heat generation sources and (B) the maximum-pressure stage pump chamber 15 and the free bearing 56 are disposed distributed on both sides sandwiching (C) the minimum-temperature stage pump chamber 11 and the pump chambers 12, 13, 14. In this manner, it is possible to make the temperature distribution of the multi-stage pump 1 uniform and to suppress the maximum temperature in the multi-stage pump 1 to a low value. As a result, it is possible to design a small gap for each pump chamber 11-15. Furthermore it is possible to ensure removal of heat in the rotor 21-25 and the cylinders 31-35 by the cooling medium passage 38 disposed in the center cylinder 30.

Figure 5:
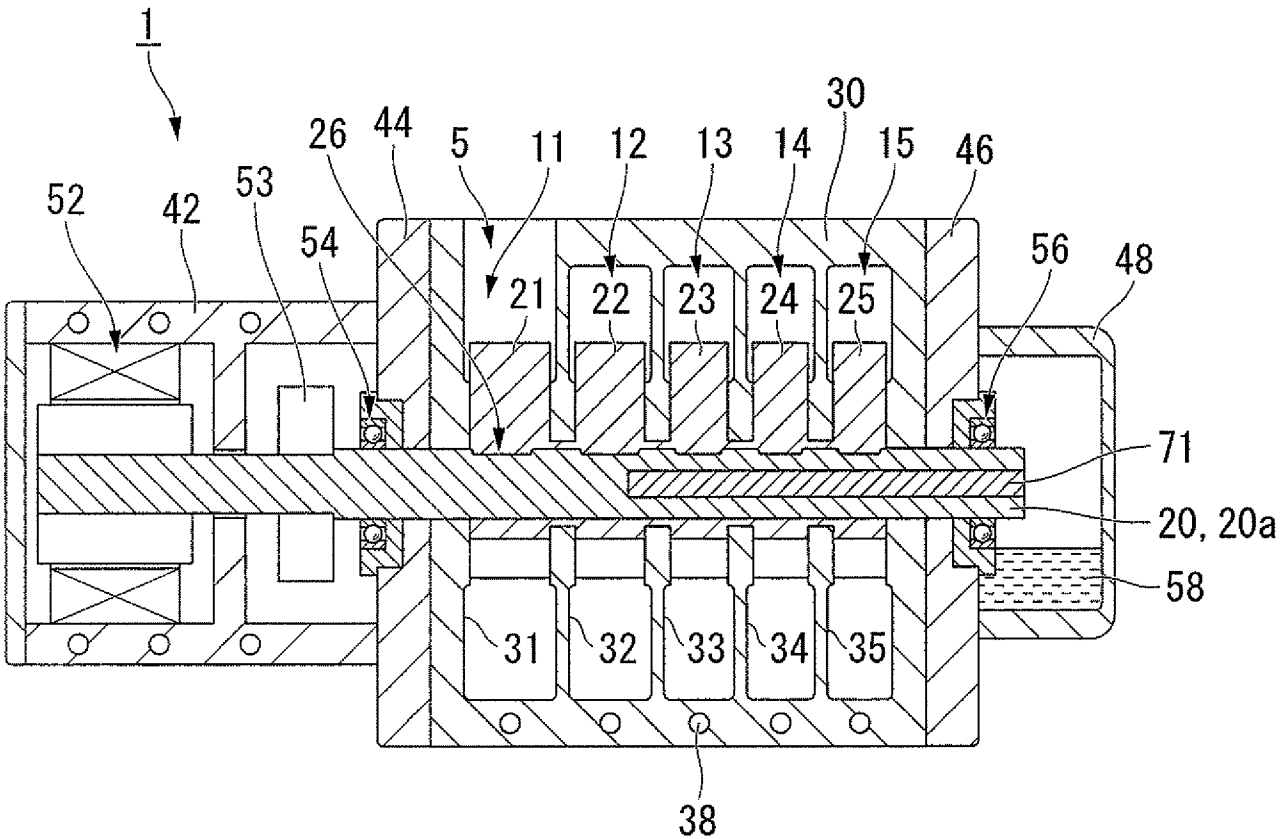
FIG. 5 is a lateral sectional view of a multi-stage dry pump according to a modified example of the first embodiment of the present invention.

FIG. 5 is a lateral sectional view of a multi-stage dry pump according to a modified example of the first embodiment of the present invention. In the modified example, a heat transmission member 71 having a higher heat transmission capacity than the rotor shaft 20 is disposed in an inner section of the rotor shaft 20. For example, the rotor shaft 20 is formed from an iron alloy and the heat transmission member 71 is formed from an aluminum alloy. It is possible to use a heat pipe as the heat transmission member 71. The end of the heat transmission member 71 is exposed to the end of the rotor shaft 20 near the free bearing 56. This configuration enables transmission of the heat of the rotor to the end of the rotor shaft 20 through the heat transmission member 71 and radiation of the heat from the end of the rotor shaft 20. Thus it is possible to efficiently remove heat in the rotor and to suppress the thermal expansion of the rotor 24, 25.

As described above, the high-pressure stage pump chambers 14, 15 which have a higher heat generation amount are disposed near to the free bearing 56. The heat transmission member 71 extends from the end of rotor shaft 20 near to the free bearing 56 to the forming region of the high-pressure stage pump chambers 14, 15. In this manner, it is possible to efficiently remove heat from the rotors 24, 25 which are disposed in the high-pressure stage pump chambers 14, 15 which have a high heat generation amount and, as a result, it is possible to decrease the temperature difference between each pump chamber.

The technical scope of the present invention is not limited to the embodiments described above and includes various modifications to each of the above embodiments within the scope of the invention. In other words, the actual materials or configurations described in the embodiments above are merely examples and suitable modification is possible.

For example, although a roots rotor with three blades was used in the multi-stage pump in the embodiments, it is possible to use other types of roots rotors (for example, five-bladed types).

Furthermore although an example was described in the embodiments using a roots pump, it is possible to apply the present invention to various types of pumps including a claw pump, screw pump or the like.

Furthermore although the multi-stage pump in the embodiments was configured by 5 stages of pump chambers, it is possible to apply the invention to a multi-stage pump other than five stages.

INDUSTRIAL APPLICABILITY

According to the present invention, since disposition is performed in proximity to the fixed bearing for low-pressure stage pump chambers having increasingly small thermal expansion amount, the amount of accumulation of the thermal expansion amount from the fixed bearing to the free bearing can be decreased. Therefore it is possible to decrease a gap in an axial direction between the rotor and the cylinder in each pump chamber.

The invention claimed is:

1. A multi-stage dry pump comprising:

a plurality of pump chambers each including a cylinder and a rotor housed in the cylinder;

a first rotor shaft that is a rotation shaft of the rotors;

a fixed bearing that rotatably supports the first rotor shaft and restricts a movement thereof along an axis direction of the first rotor shaft; and a free bearing that rotatably supports the first rotor shaft and permits a movement thereof along the axis direction of the first rotor shaft, wherein:

the plurality of pump chambers is disposed between the fixed bearing and the free bearing;

a first pump chamber of the plurality of pump chambers which has a lower pressure and on the aspiration side is placed in proximity to the fixed bearing; and a gap in the axis direction between the rotor and the cylinder in a pump chamber which has a maximum compression work amount among the plurality of pump chambers is larger than a gap in the axis direction of the rotor and the cylinder in the other pump chambers of the plurality of pump chambers.

2. The multi-stage dry pump according to claim 1 further comprising:

an electrical motor that is disposed on an opposite side of the fixed bearing with respect to the free bearing and that applies a rotational drive force to the first rotor shaft;

a second rotor shaft that is a rotation shaft for another plurality of the rotors; and a timing gear that is disposed between the fixed bearing and the electrical motor, and that transmits a rotation drive force from the first rotor shaft to the second rotor shaft.

3. The multi-stage dry pump according to claim 1 wherein, a heat transmission member having a higher heat transmission capacity than the first rotor shaft is disposed in an inner section of the first rotor shaft, and the end of the heat transmission member is exposed to the end of the first rotor shaft on the free bearing side.

* * * * *